United States Patent [19]

Grether

[11] 4,334,398

[45] Jun. 15, 1982

[54] INSULATING ELEMENT FOR A MULTI-PANED WINDOW

[75] Inventor: Paul Grether, Seuzach, Switzerland

[73] Assignee: Sulzer Brothers Limited, Winterthur, Switzerland

[21] Appl. No.: 92,368

[22] Filed: Nov. 8, 1979

[30] Foreign Application Priority Data

Nov. 17, 1978 [CH] Switzerland ..... 11822/78

[51] Int. Cl.[3] ..... E04C 1/42; E04C 2/34

[52] U.S. Cl. ..... 52/789; 52/222

[58] Field of Search ..... 52/222, 788–790

[56] References Cited

U.S. PATENT DOCUMENTS

| | | | |
|---|---|---|---|
| 1,708,351 | 4/1929 | Auld | 52/222 |
| 1,910,608 | 5/1933 | Tankers | 52/222 |
| 1,988,964 | 1/1935 | Barrows | 52/789 |
| 2,817,399 | 12/1957 | Donaldson | 52/222 |
| 3,180,220 | 4/1965 | Teffree | 52/222 |
| 3,448,551 | 6/1969 | Heller | 52/222 |
| 3,841,039 | 10/1974 | Farnsworth | 52/81 |
| 4,045,931 | 9/1977 | Becker | 52/222 |

FOREIGN PATENT DOCUMENTS

| | | | |
|---|---|---|---|
| 891914 | 3/1962 | United Kingdom | 52/222 |

*Primary Examiner*—Price C. Faw, Jr.
*Assistant Examiner*—Henry E. Raduazo
*Attorney, Agent, or Firm*—Kenyon & Kenyon

[57] ABSTRACT

The multi-paned window is provided with an insulating element made of plastic film. The film is bi-axially stretched within the window frame by a clamping means in a uniform manner. The clamping means employs elongated elements which cooperate with each side of the film along an arcuate line so that in a clamped state, the film is caused to stretch bi-axially. The elongated elements may fit together as a frame or may be separate from each other.

17 Claims, 15 Drawing Figures

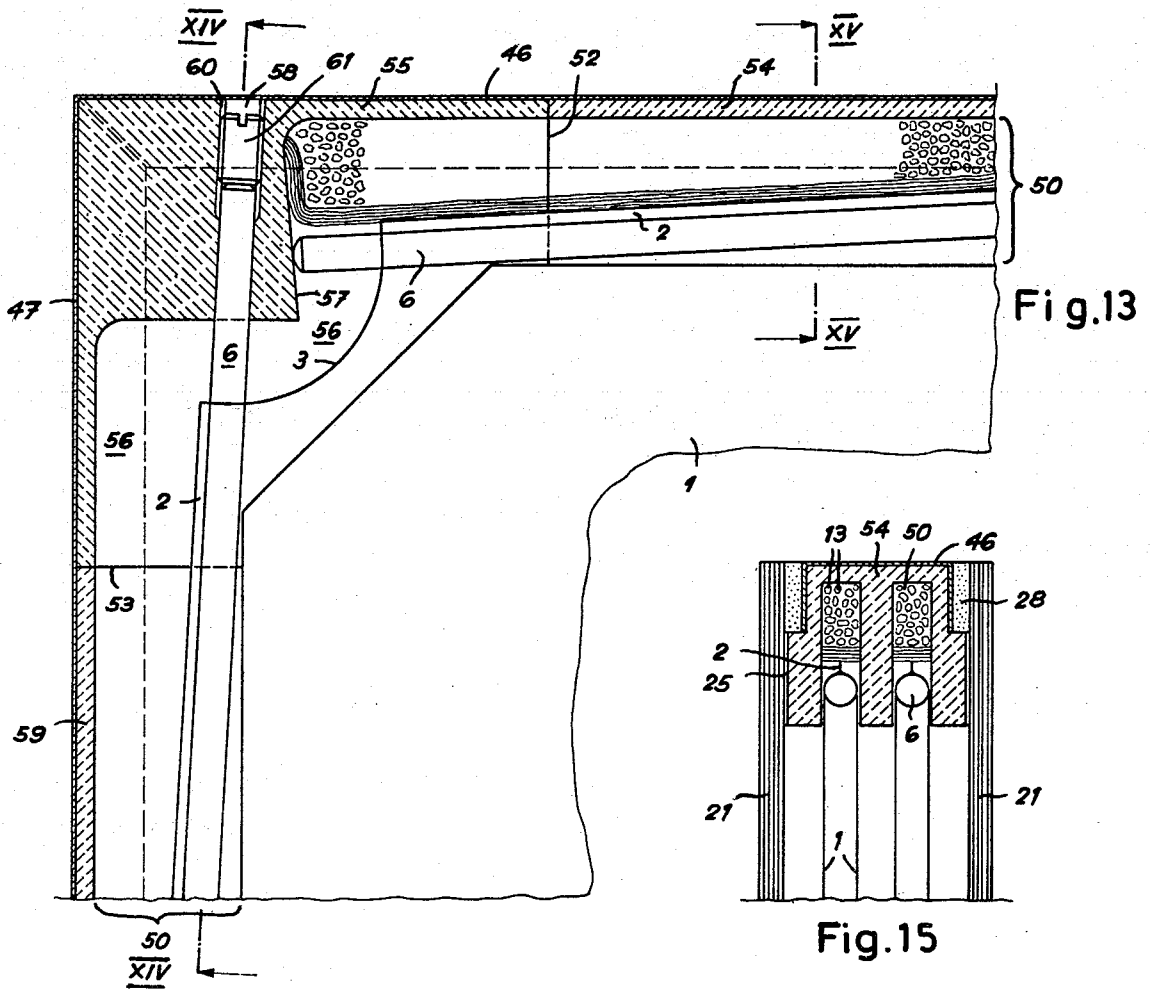
Fig.13
Fig.15
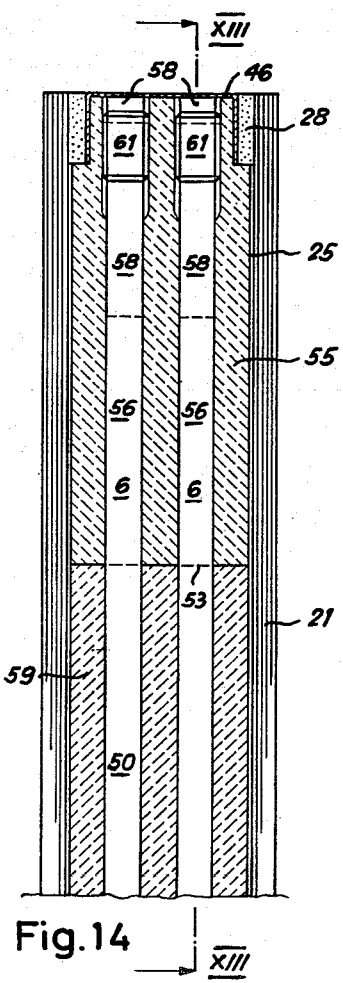
Fig.14

INSULATING ELEMENT FOR A MULTI-PANED WINDOW

This invention relates to an insulating element for a multi-paned window.

As is known, for example, from Swiss Pat. Nos. 351,095; 424,181 and 588,627, the heat transfer coefficient of a double or multi-paned window can be considerably reduced by transparent plastic films, sheets or foils which are stretched in the air space in planes between and parallel to window panes. However, multipaned windows of this type have not hitherto been successful in practice in spite of the low cost of material and the high technical efficiency of films stretched between two panes. One reason is that there has been no economic method found of biaxially stretching the films and holding the films when they are biaxially stretched. Also, there are manifest difficulties in holding the films so that they do not fold in spite of differences in thermal expansion or shrinkage between the stretched films and the holders.

Accordingly, it is an object of this invention to provide an insulating element made of stretched films for insertion between the panes of a multi-paned window wherein the films are biaxially and uniformly stretched over the entire length of a side in simple economic manner.

It is another object of the invention to provide an insulating element for a multi-paned window wherein a transparent film can be held in a uniformly tensioned manner.

It is another object of the invention to provide an insulating element of relatively low cost for a multi-paned window.

It is another object of the invention to provide a relatively simple means of clamping transparent films within an insulation element for use in a multi-paned window.

It is another object of the invention to provide an insulating element wherein a pair of films can be stretched without folding even when there are differences in thermal expansion between the folder and films.

Briefly, the invention provides an insulation element for use between the panels of a multi-paned window. The insulation element is comprised of a pair of transparent films disposed in overlying sandwiched relation to each other and joined together along a major part of each side. In addition, a clamping means is provided for biaxially stretching the films. This clamping means includes a plurality of elongated elements with each elongated element being disposed along a respective side of said joined films whereby in an unclamped state said elongated elements and respective sides of said joined films are disposed with at least one of said elements and sides bent along an arcuate line relative to the other of said elements and sides in order to obtain a uniform tensioning of the films. In this way, each elongated element is free to move relative to the films and to expand and contract at a different rate from the films.

The films, which are advantageously between 10 and 30 μm thick, are permanently joined, e.g. by welding, gluing, sticking, sewing or clamping, so that the films do not need to be secured to the clamping means. As a result, the joined films are movable relative to the clamping means, at least in the longitudinal direction of each side, so that the clamping means or holders can move relative to the films and thus expand or contract at a different rate from the films.

Uniform tensile forces over the entire length of the side are obtained in that the joint between the films and/or the facing edge of the clamping means, when not clamped, is made to extend along a curve which continuously bends to one side. Advantageously, the curve, at least approximately, follows the bending line of a uniformly loaded simple beam, i.e. a freely supported beam, or the catenary curve of a freely sagging cable. Of course, these parabolas, which are relatively complicated to produce, can be replaced, within certain tolerances, by arcs of a circle or other simpler functions. Furthermore, the desired curve (with regard to the spacing between the aforementioned edges of the films and the unclamped clamping means) can also be obtained by distributing the resulting, final curve between the boundary lines of both elements, i.e. the joint between the films and the unclamped clamping means, and/or by using suitably-shaped, preferably resilient intermediate members. For example, the clamping means, e.g. a frame having a hollow cross-section, which are expensive to shape within the permitted tolerance, can have a straight outer edge and the films can be fitted together along the desired curve. Alternatively, the clamping means can be sectional and straight or only slightly curved, and the joint between the films is likewise straight or only slightly curved and a suitably shaped intermediate member, advantageously of plastics, is placed between the two components.

Advantageously, the elements of the clamping means are connected together to define a self-supporting frame, thus allowing the insulation element to be inserted between existing double windows. The frames can be either inner or outer frames.

The forces applied by the clamping means are kept to a minimum. In the case, for example, of a commercial polyester-based film about 12 μm thick, clamping forces of e.g. 0.6 to 1.2 N/cm side length are sufficient to stretch the films taut and hold them without folding or irregularity.

These and other objects and advantages of the invention will become more apparent from the following detailed description taken in conjunction with the accompanying drawings wherein:

FIG. 1 diagrammatically illustrates an insulation element according to the invention when unclamped;

FIG. 2 diagrammatically illustrates a modified insulation element according to the invention;

FIG. 3 diagrammatically illustrates one longitudinal side of the insulation element of FIG. 2;

Figure 8:
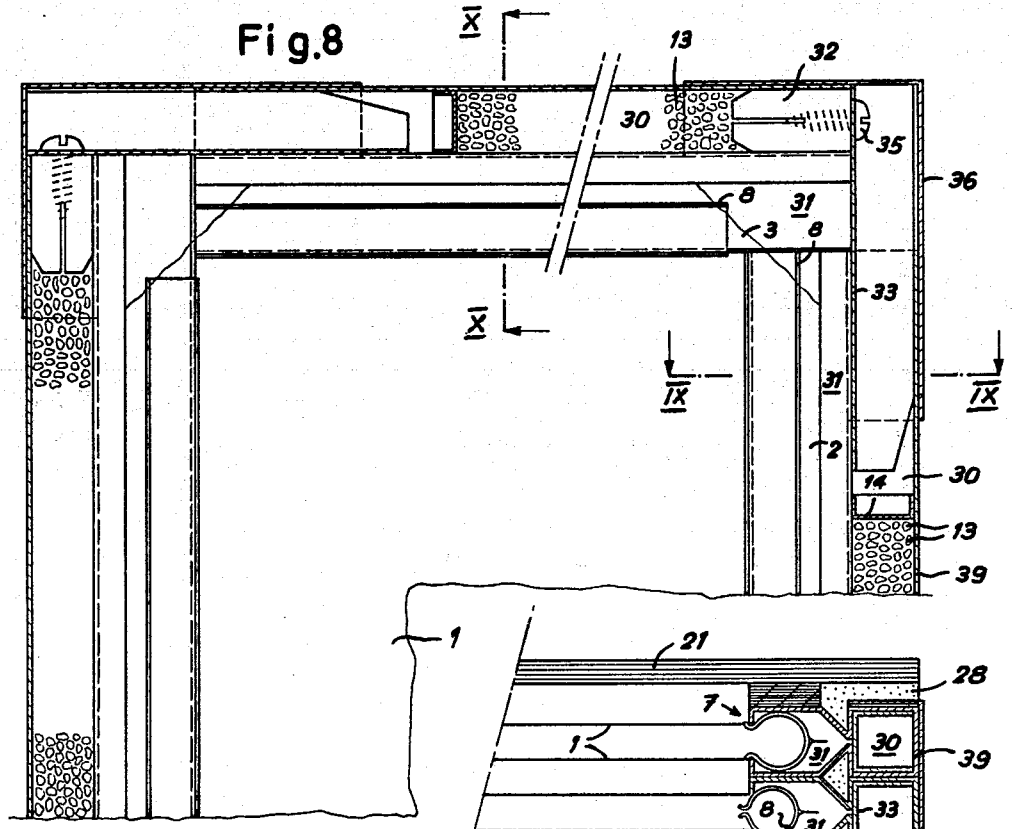
Figure 9:
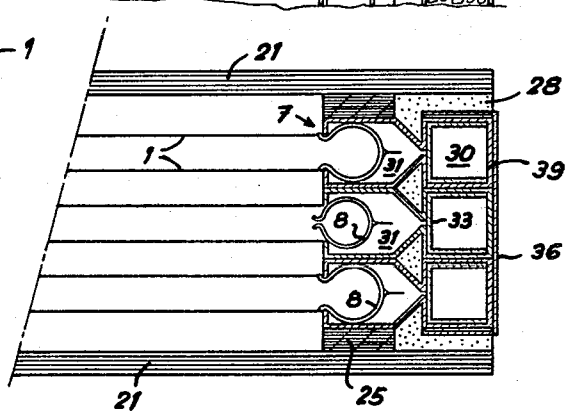
Figure 10:
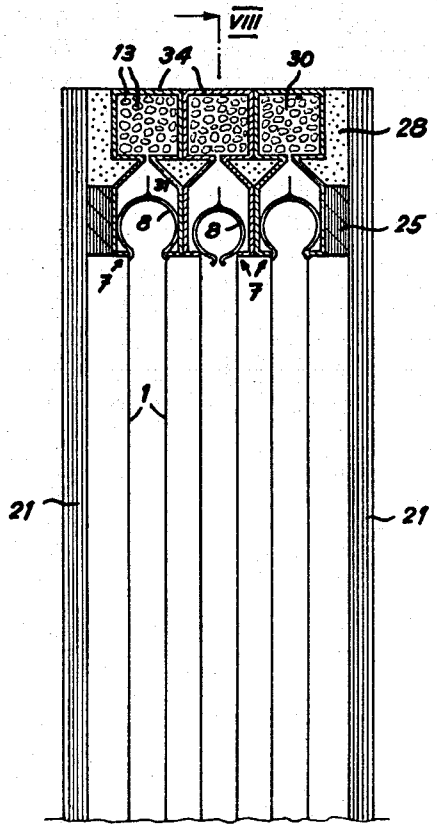
Figure 11:
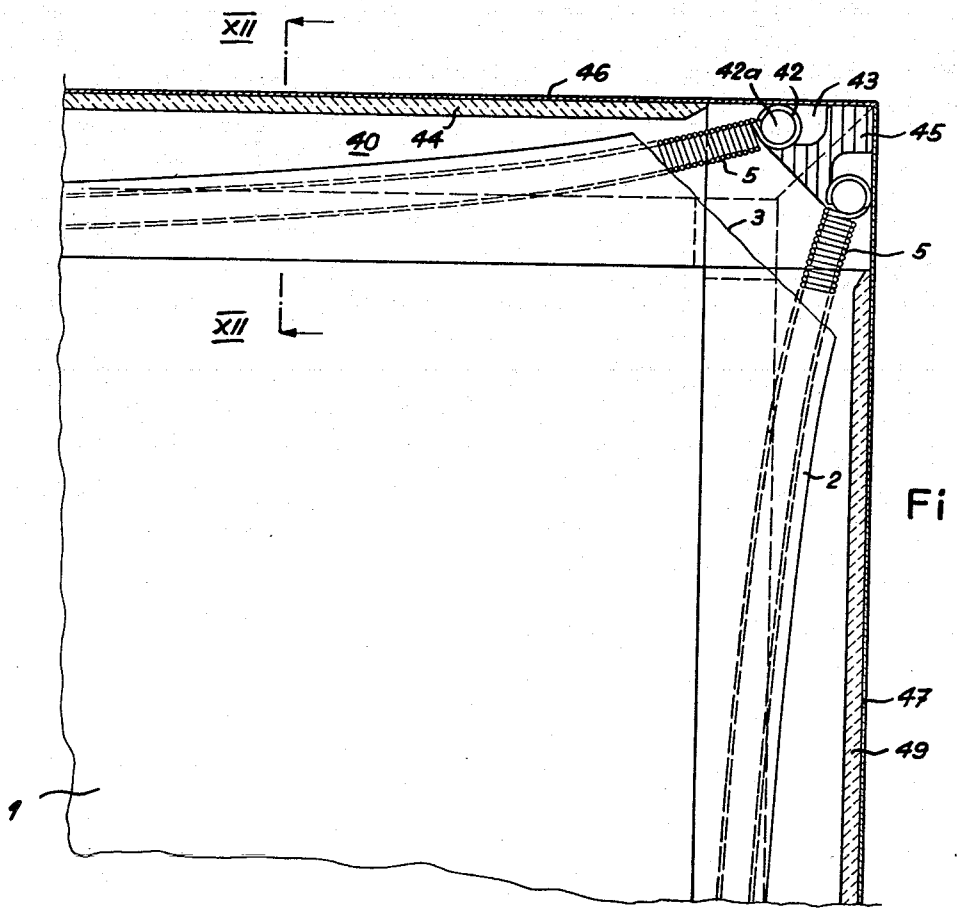
Figure 12:
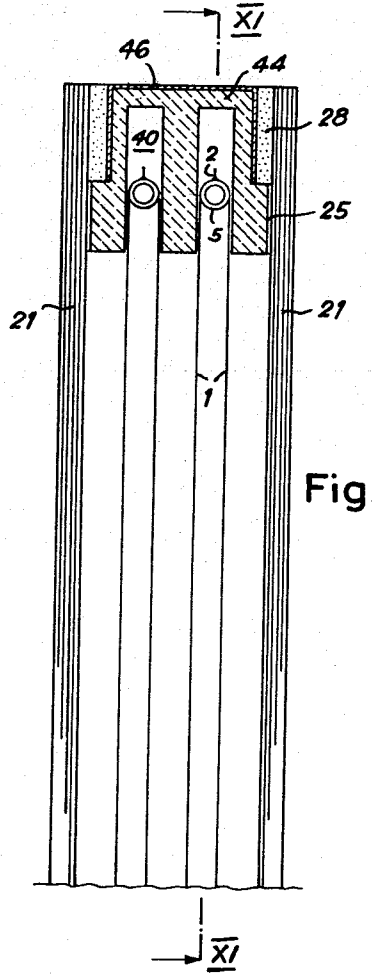

FIG. 8 diagrammatically illustrates a view taken taken on line VIII—VIII of FIG. 10 of another embodiment of a multi-paned window according to the invention;

FIG. 9 illustrates a view taken on line IX—IX of FIG. 8;

FIG. 10 illustrates a view taken on line X—X of FIG. 8;

FIG. 11 illustrates a view taken on line XI—XI of FIG. 12 of a further modified multi-paned window according to the invention;

FIG. 12 illustrates a view taken on line XII—XII of FIG. 11;

FIG. 13 illustrates a view taken on line XIII—XIII of FIG. 12;

FIG. 14 illustrates a view taken on line XIV—XIV of FIG. 13; and

FIG. 15 illustrates a view taken on line XV—XV of FIG. 13.

Figure 1:
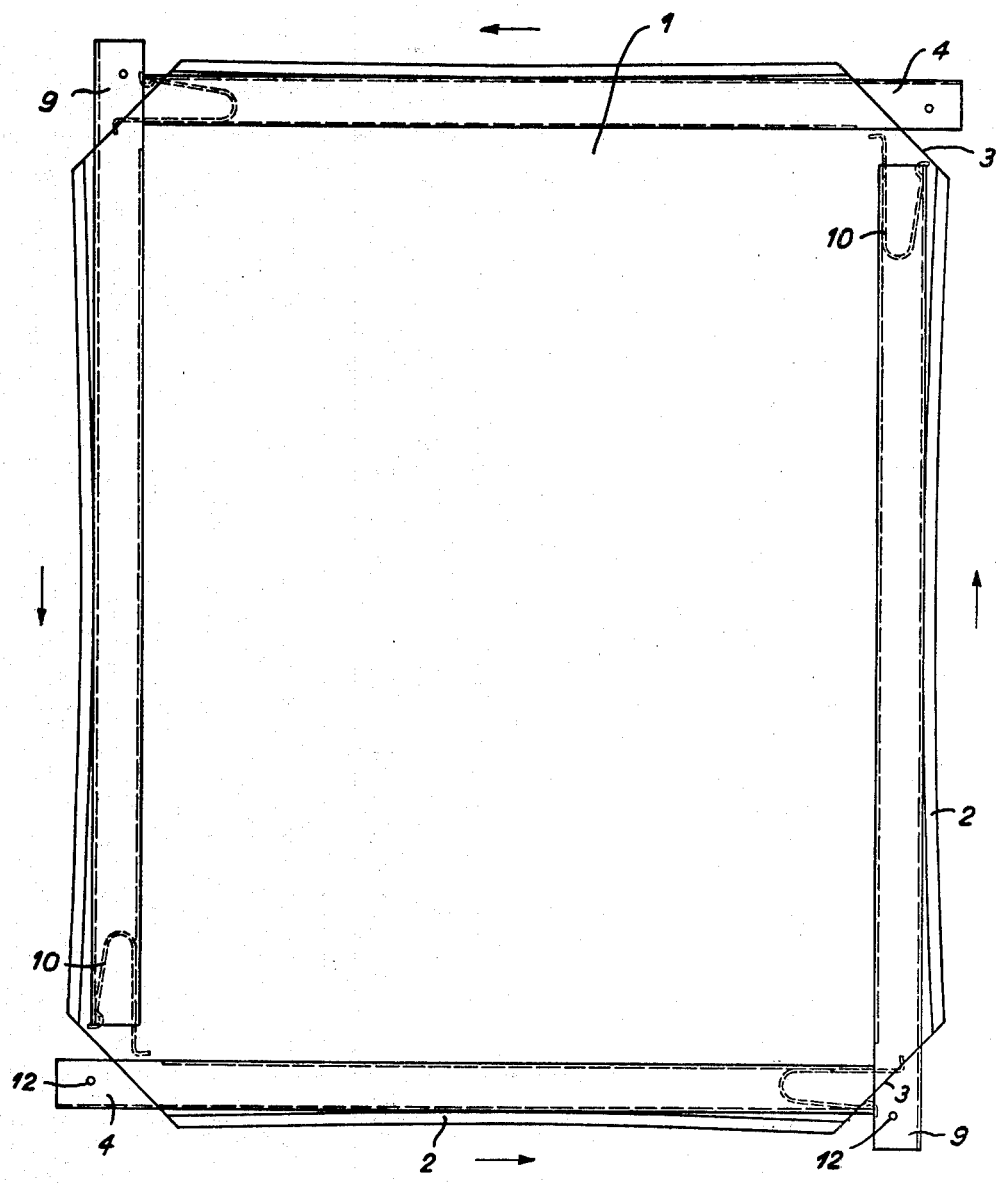

Referring to FIG. 1, the insulation element is comprised of a pair of transparent films 1 which are disposed in overlying sandwiched relation to each other and are joined together along a major part each of the four sides thereof. In the various illustrated embodiments, the films are welded together to form seams 2 by suitable welding machines (not shown). The films may be of any suitable commercial type such, for example, as polyester and may have a thickness of 12 microns.

In addition, the insulation element includes a clamping means for biaxially stretching the films 1. This means includes a plurality of elongated elements 4, 9 which are interconnected together to form a self-supporting frame.

In order to obtain a uniform biaxial tension in the films 1 after stretching them, the seams 2 extend along a curve which always curves to one side, preferably the bending line of a uniformly loaded simple beam (FIG. 1) or the catenary curve of a freely sagging cable (FIGS. 11 and 13). However, these parabolas, which are higher-order curves, can be approximated or replaced by curves of simple functions, preferably conic-section curves, more particularly arcs of a circle. Alternatively, of course, the films can be joined by a straight seam (FIGS. 2 and 3) and the distance to the associated side of the frame, when unclamped, can be varied as required by giving the frame side a curved shape, as will be described later.

The exact shape of the individual bending line or catenary curve or of the simpler curve used by way of approximation depends on the material and shape of the associated frame or section member, e.g. the elasticity modulus of the frame material and the moment of inertia of the cross-section. The clamping forces and the length or span width of the sides of the films 1 to be joined must also be allowed for when calculating the curves. The clamping forces are kept at a minimum and made just large enough to compensate all folds and irregularities in the joined films 1. Tests with 12 $\mu$m thick foils have shown, for example, that clamping forces of 0.6 to 1.2 N/cm side length are suitable.

Figure 4:
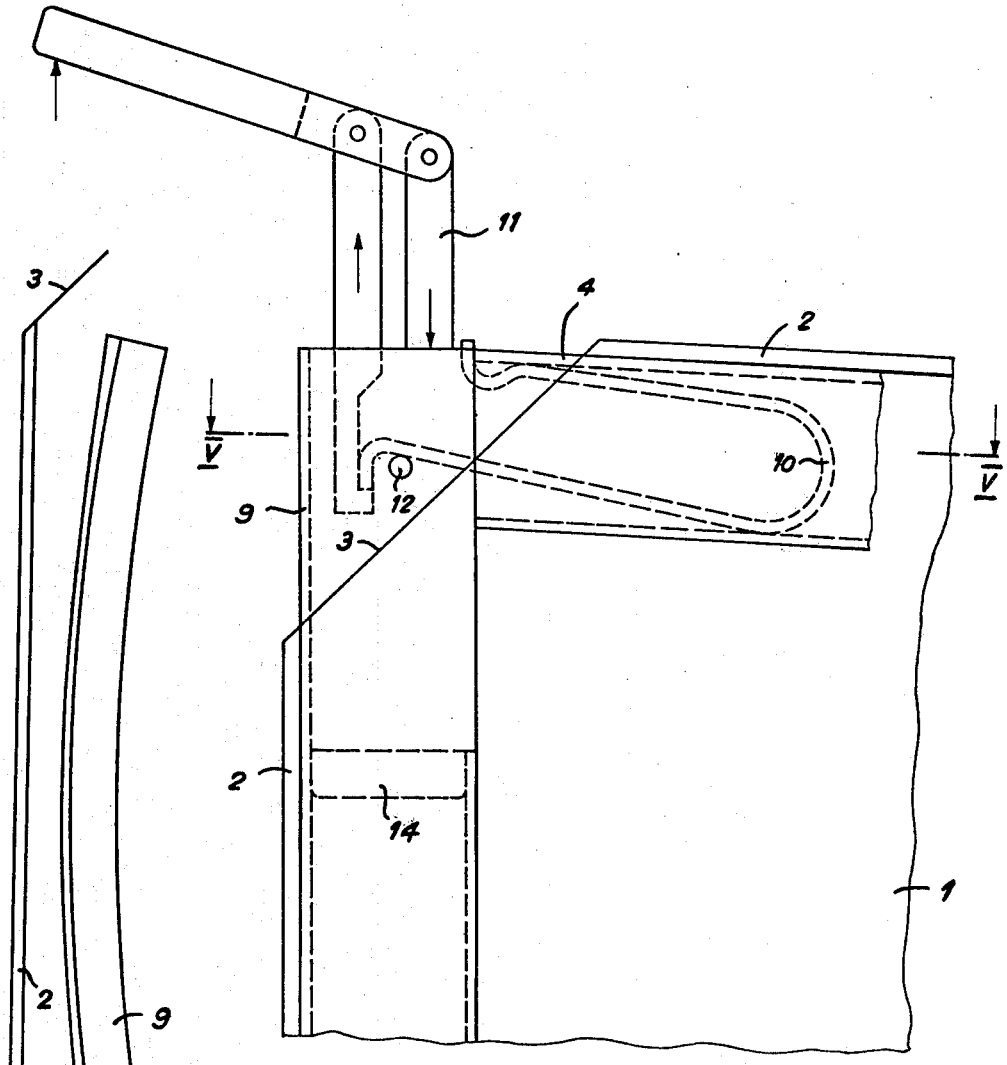
FIG. 4 illustrates a detail of the element of FIG. 1.
Figure 5:
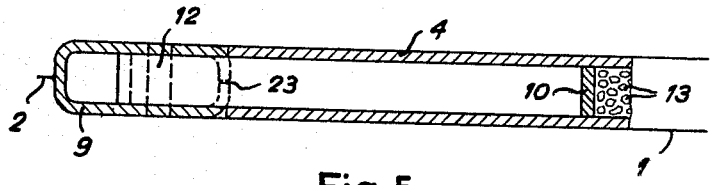
FIG. 5 illustrates a view taken on line V—V of FIG. 4.

Referring to FIGS. 1, 4 and 5, the seams 2 between films 1 extend along a bending line while the elements 4, 9 of the frame are straight. Advantageously, the cross-section of each frame element 4, 9 (FIG. 5) is that of a rectangular tube. At one end of each side element 4, 9, the rectangular side facing the interior of the frame is removed by a certain distance, so that the adjacent side element 9, 4 can be inserted.

Figure 2:
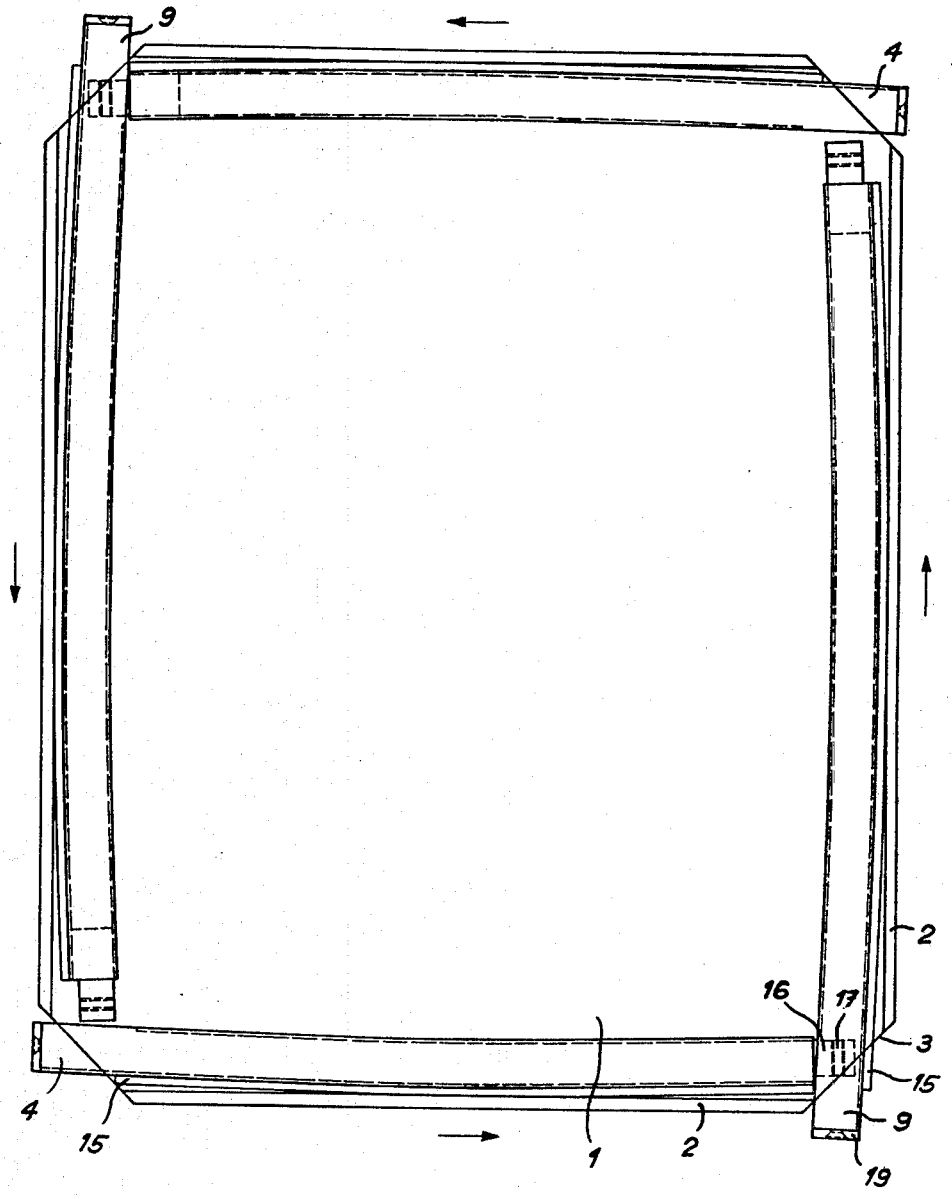
Figure 3:
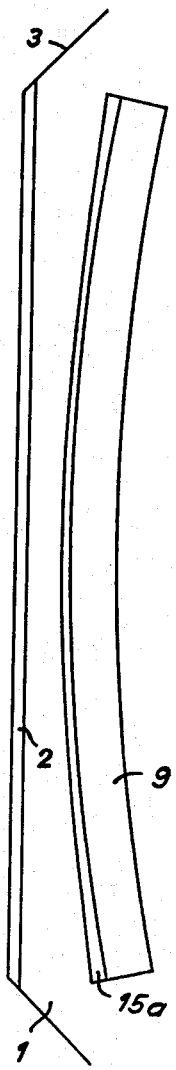

As shown by arrows in FIGS. 1 and 2, the side elements 4, 9 which are at an angle to one another, are clamped in the longitudinal direction via resilient connecting elements 10.

Referring to FIG. 4 the resilient connecting elements 10 are spring elements in the form of hairpin-shaped leaf springs 10 inserted into the open cross-section in each side element 4, 9. One bent end of each spring 10 bears on the edge of the frame cross-section, thus preventing the spring 10 from slipping into the side element 4, 9. The other end of the spring 10 bears on a pin 12 in the adjacent side element 9, 4. The spring constant of the springs 10 is such that the springs 10 exert the required tension forces for compensating manufacturing tolerances in the welding of the films 1 and the side elements 4, 9 of the frames, and differences in the thermal expansion of the films 1 and side elements 4, 9 are compensated. The springs 10 are constructed, e.g. by matching their width to the internal cross-section of the side elements 4, 9, so that the parts of the springs 10 projecting into the cross-section of the side elements 4, 9 prevent the side elements 4, 9 from lateral tilting under load.

A moisture-absorbing granulate 13 can be poured into the cavity inside the side elements 4, 9, thus drying the air between the films 1 via fine bores 23 in the frame cross-sections. The granulate 13 is prevented from flowing out of the cavity in the sectional elements 4, 9 by the springs 10 at one end and by a plug 14 at the other end of each side element 4, 9.

The moisture-bonding granulate 13 is advantageously a "physical" drying agent which absorbs moisture. Materials of this kind, which are zeolite-based, are commercially obtainable and known as "molecular sieves".

The side elements 4, 9 of the clamping frame which are perpendicular to one another in the final state, are clamped as follows. A lever-like clamping tool 11, which bears on one side element 9 engages one end of a spring 10 in an adjacent element 4, compresses the spring 10 and pushes the facing ends of the side elements 4 and 9 together. When the side elements 4 and 9 are in the right position for the clamped frame, a pin 12 is inserted in the end of the side element 9, the end of spring 10 is placed thereon and the tool 11 is withdrawn. The direction of motion of the individual parts of the tool 11, during the process of clamping the side elements 4, 9 together, are shown by arrows in FIG. 4. The remaining ends of the elements 4, 9 are connected in the same manner. The elements 4, 9 are thus held under tension by forces extending parallel to the films 1. When in the clamped state, the clamping means 4, 9 biaxially stretches the films 1. To this end, each element 4, 9 is in at least partial engagement with an edge of the joined films 1 along an line of contact to obtain a uniform tensioning of the films 1. In this way, each element 4, 9 is free to move relative to the films 1 and to expand and contract at a different rate from the films 1.

The embodiment in FIG. 2 differs only in detail from FIG. 1. In this embodiment, the seams 2 are straight and the side elements 4, 9 are bent. The cross-sections, usually made of sheet-metal, of the side elements 4, 9 are advantageously simple arcs. If required, they are adapted to the bending lines by means of plastics intermediate members 15 stuck to the outside of the metal section members. For simplicity, the members 15 can also be bent in an arc of a circle and be adapted to the bending line simply because they are more resilient than the metal section member. In more exacting circumstances, however, the outer edge of the intermediate member 15 can be given the same curve as the bending line, i.e. (as illustrated by the intermediate member 15*a* in FIG. 3) the height of the member 15 can continuously increase from the center to both sides, relative to the arc of a circle at the base.

Further, instead of using springs, the side elements 4, 9 are connected by members 16 which are fitted at one end into the open cross-section of the side elements 4, 9.

The projecting end of each member 16 has a thread 17 for screwing a screw bolt (FIG. 6) having a head which can be countersunk in a plate 19 which seals the other end of the adjacent side elements 4, 9.

Figure 6:
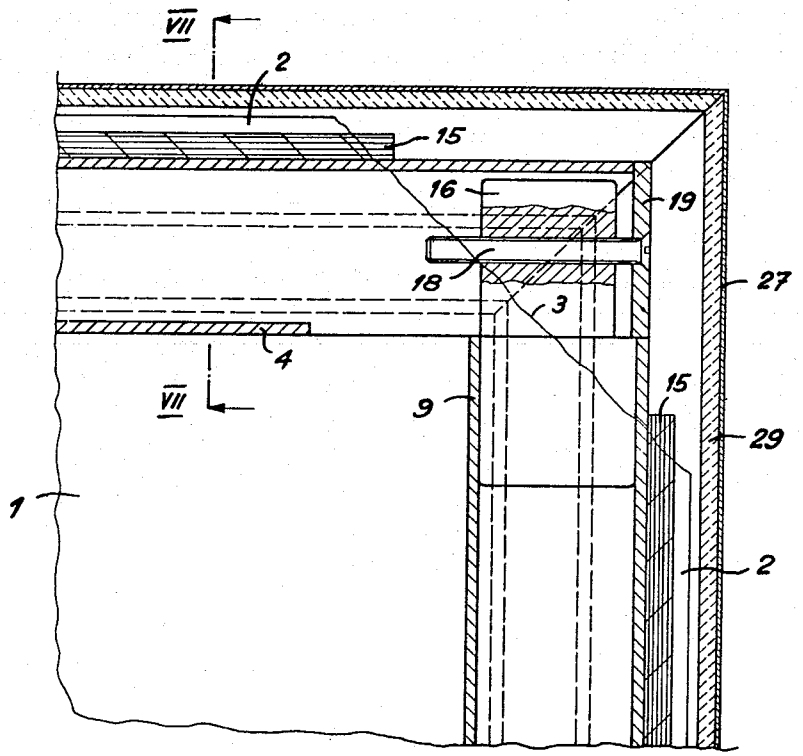
FIG. 6 illustrates a view taken on line VI—VI of FIG. 7 of a multi-paned window equipped with an insulation element according to the embodiment of FIG. 2.
Figure 7:
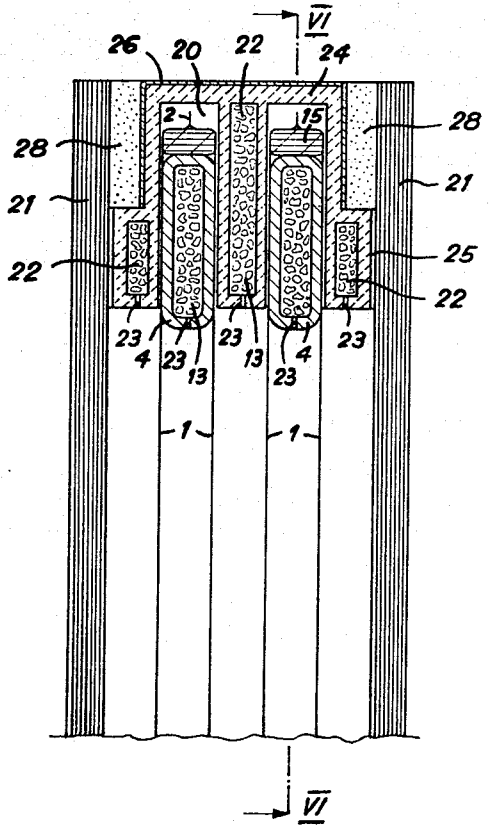
FIG. 7 illustrates a view taken on line VIII—VIII of FIG. 6.

Referring to FIGS. 6 and 7, a pair of insulating elements constructed in accordance with FIG. 2 are used to make a multi-paned or multi-glazed window. These elements are inserted into longitudinal slots 20 in spacers 24, 29 made of plastics which is a poor conductor of heat. The spacers 24, 29 have a substantially W-shaped cross-section with three arms having cavities 22 filled with moisture-absorbing granulate 13 and connected by bores 23 to the air spaces between the facing films 1 in the two insulating elements or between a film 1 and a pane 21 of the multi-glazed window.

The two outer free arms of the W-shaped spacers 24, 29 are secured to the panes 21, e.g. by strips 25 which are adhesive on both sides. U-shaped caps 26, 27 are placed over the base parts of the spacers 24, 29, thus providing a gas-tight seal preventing moisture from penetrating from outside. The spaces between the caps 26, 27 and the panes 21 are filled with putty and/or a sealing material 28 having a low permeability to water vapor and used as an adhesive and sealing compound.

Since the insulating elements are constructed as individual self-supporting members and the panes 21 do not need to receive any tension forces or bear any weight, the adhesive joints made with the strips 25 or material 28 have all the strength needed since they are mainly used only as seals against moisture.

Referring to FIGS. 8 to 10, a multi-paned window is provided with three insulating elements each of which is comprised of a pair of films 1 and a clamping means which is constructed as a frame 7 located outside the joined films 1. As shown, the frame side elements 34, 39 have a cross-section as shown in FIGS. 9 and 10, in which two cavities 30, 31 extend along the length of side elements 34, 39. As above, the outer cavity 30 is filled with a moisture absorbing granulate 13 which is prevented from falling out by plugs 14 at one end and by plastics closure members 32 inserted at the other end.

In this embodiment, the seams joining the films 1 are straight and the side elements 34, 39, when not under tension, are bent in a bending line or in an arc. In this case, any inaccuracies in the manufacture of the seam joining the films 1 and/or in the bending of the side elements 34, 39 are compensated by resilient intermediate members 8 which, as in the case of the side elements 4, 9 in the previous embodiments, are inserted through openings 3 between the films 1. The members 8, which are constructed in the form of plastics or thin sheet-metal tubes slotted along a generatrix, are located in the cavities 31 of the frame side elements 34, 39. As shown by their different diameters in FIGS. 9 and 10, the members 8 are compressed to a varying extent, depending on local stresses, to compensate for the aforementioned tolerances in manufacture.

The pairs of adjacent frame side elements 34, 39 are joined by U-shaped end members 33 inserted at each corner into the cavities 30 in one of the two side elements 34, 39. When clamped, the end members 33 act as abutments for bearing the other adjacent side element 39 or 34, for which purpose the members 33 are secured by plastic screws 35 to closure members 32 inserted in the adjacent side element 39 or 34.

A hood-like angle member 36 having a U cross-section is placed over each corner or meeting place between the side elements 34 and 39 and provides a water-vapor tight seal. The edges of each member 36 are firmly secured to the side elements 34 and 39, e.g. by soldering.

As above, the side elements 34, 39 are secured to the panes 21 by strips 25 which are adhesive on both sides. The outer cavity remaining between the outer frames 7 and panes 21 is filled with a sealing compound 28 as in the previous example, so that the entire space between the panes 21 is closed in sealing-tight manner.

Referring to FIGS. 11 and 12, the films 1 of an insulating element can be clamped by a clamping means in the form of a plurality of tension cables 5. In this case, the films 1 are joined at least approximately along a catenary curve. As indicated, the cables 5 are resilient in the longitudinal direction and are made of helical springs. These cables 5 extend in longitudinal slots 40 (FIG. 12) in plastic spacers or side elements 44, 49 of a supporting frame. The ends of each cable 5 are bent into loops 42 and, at each corner, pins **42*a* inserted through the loops suspend them in recesses 43 of a tube or square-shaped block 45, likewise made of plastics. Each block 45 also serves as an abutment for two adjacent frame side elements 44, 49**.

The outward facing bases of the side elements 44 and 49 and block 45 are surrounded by hood-like caps 46, 47 of sheet metal or foil, producing a moisture-tight closure of the space between the panes 21 (FIG. 12). The caps 46, 47 are joined in gas-tight manner, e.g. by welding, at the corners. As above, the space between the caps 46, 47 and panes 21 is sealed by putty or a sealing compound 28. As in the previous examples, the panes 21 are secured to the side elements 44, 49 by strips 25 which are adhesive on both sides.

Referring to FIGS. 13 to 15, the clamping means for an insulating element may also be in the form of a bent compression member 6, extending in slots 50 in spacers or frame side elements 54, 59. The slots 50 also contain a granulate 13 which is held in place by a porous mat 51 of fibrous material.

As above, the curve of the seam between the two films 1 necessary for uniform biaxial tension is at least approximatly a catenary which, in contrast to the preceding example, is outwardly convex, since a tension cable is replaced by pressure exerted by the compression members 6.

The side elements 54 and 59 of the clamping frame are of plastics and are connected at their ends by plastic corner blocks 55, i.e. by being welded to the blocks 55 along surfaces 52, 53. The slots 50 merge into matching slots 56 in the blocks 55. These latter slots 56 have a slightly oblique, inwardly inclined end wall 57 which receive a rounded ends of a compression member 6. Each end wall 57 is made to slope so as to prevent the compression member 6 from slipping into the interior of the frame when clamping begins.

The other end of each compression member 6 is guided through a bore 58 in a solid part of each block 55. A thread 60 is cut in the outer region of each bore 58 and a set screw 61 is threaded into the bore 58 for the purpose of imposing a load on the member 6.

In this embodiment of a multi-glazed window, metal caps 46, 47 and a sealing compound 28 serve the purposes which have already been described above.

If required, the process of manufacturing the seams 2 along the calculated curves can be simplified by a programmed electronic control of the welding, sewing or gluing machines. Advantageously, the process is as follows: First, two superposed taut—but not yet clamped—films are formed into a peripherally closed bag by making the seams 2, after which the corners are cut off, forming openings 3 through which the sides 4, 9 of an inner frame used as a clamping means (FIGS. 1–7) or tension cables 5 (FIGS. 11 and 12) or compression members 6 (FIGS. 13–15) or, if an outer frame 7 is used, resilient intermediate members 8 (FIGS. 8–10) are inserted between the two films 1.

What is claimed is:

1. An insulation element for use between the panels of a multi-pane window comprising a pair of transparent films disposed in overlying sandwiched relation to each other and joined together along a major part of each side thereof; and clamping means for biaxially stretching said films, said means including a plurality of elongated elements with each elongated element being disposed along a respective side of said joined films whereby in unclamped state said elongated elements and respective sides of said joined films are disposed with at least one of said elements and sides bent along an arcuate line relative to the other of said elements and sides to obtain a uniform tensioning of said films whereby each said elongated element is free to move relative to said films and to expand and contract at a different rate from said films.

2. An insulation element as set forth in claim 1 wherein said elements of said clamping means are held under tension by forces extending parallel to said films.

3. An insulation element as set forth in claim 1 wherein said elongated elements are connected together to define a self-supporting frame.

4. An insulation element as set forth in claim 3 wherein said frame is disposed between said films.

5. An insulation element as set forth in claim 1 wherein the shape of said arcuate line corresponds to the bent axis of a uniformly loaded simple beam.

6. An insulation element as set forth in claim 1 wherein the shape of said arcuate line corresponds to the catenary of a uniformly loaded sagging cable.

7. An insulation element as set forth in claim 1 which further comprises a plurality of intermediate members, each said member being disposed between an elongated member and an edge of said joined films.

8. An insulation element as set forth in claim 1 wherein said elongated members are connected together to define a self-supporting frame outside said films and which further comprises a plurality of resilient intermediate members, each resilient member being inserted between said films and held in said frame.

9. An insulation element as set forth in claim 1 wherein each elongated element is a tension cable.

10. An insulation element as set forth in claim 9 wherein each cable is resilient along a longitudinal axis thereof.

11. An insulation element as set forth in claim 1 wherein each elongated element is a compression member.

12. An insulation element as set forth in claim 1 wherein said clamping means includes a plurality of spring elements, each spring element clamping a pair of elongated elements together.

13. An insulation element as set forth in claim 12 wherein each spring element is shaped to prevent said clamped elongated elements from tilting relative to each other.

14. An insulation element for a multi-pane window comprising a pair of rectangular transparent films disposed in overlying relation to each other and joined together along a major part of each side thereof; and clamping means for stretching said films, said means including four elongated elements, each said elongated element being disposed along a respective side of said joined films whereby in an unclamped state said elongated elements and respective sides of said joined films are disposed with one of said elements and sides bent along an arcuate line relative to the other of said elements and sides.

15. An insulation element as set forth in claim 14 wherein each said elongated element is disposed between said films and has at least one end projecting from between said films.

16. An insulation element as set forth in claim 14 which further comprises a plurality of intermediate members, each said member being disposed between an elongated member and an edge of said joined films.

17. In combination, a multi-plane window having a pair of panes defining an enclosed space therebetween;

an insulation element disposed in said space, said element including a pair of transparent films disposed in overlying sandwiched relation to each other and joined together along a major part of each side thereof; and clamping means for biaxially streching said films, said means including a plurality of elongated elements with each elongated element being disposed along a respective side of said joined films whereby in unclamped state said elongated elements and respective sides of said joined films are disposed with at least one of said elements and sides bent along an arcuate line relative to the other of said elements and sides to obtain a uniform tensioning of said films whereby each said elongated element is free to move relative to said films and to expand and contract at a different rate from said films.

* * * * *

UNITED STATES PATENT AND TRADEMARK OFFICE

CERTIFICATE OF CORRECTION

PATENT NO. : 4,334,398

DATED : June 15, 1982

INVENTOR(S) : Paul Grether

It is certified that error appears in the above—identified patent and that said Letters Patent is hereby corrected as shown below:

Col. 2, line 59, change "VIII-VIII" to --VII-VII--.

Col. 3, line 7 change "12" to --14--.

Signed and Sealed this

*Fourteenth* Day of *September 1982*

[SEAL]

*Attest:*

GERALD J. MOSSINGHOFF

*Attesting Officer* *Commissioner of Patents and Trademarks*